US007222596B2

(12) United States Patent
Stiegler

(10) Patent No.: US 7,222,596 B2
(45) Date of Patent: May 29, 2007

(54) VALVE DRIVE FOR CHARGE-CYCLING VALVES OF INTERNAL COMBUSTION ENGINES

(75) Inventor: Lutz Stiegler, Kändler (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 21 days.

(21) Appl. No.: 11/198,537

(22) Filed: Aug. 5, 2005

(65) Prior Publication Data

US 2006/0027195 A1 Feb. 9, 2006

(30) Foreign Application Priority Data

Aug. 7, 2004 (DE) ..... 10 2004 038 473

(51) Int. Cl.
*F01L 1/34* (2006.01)

(52) U.S. Cl. ..... 123/90.16; 123/90.44; 123/90.6

(58) Field of Classification Search ..... 123/90.16, 123/90.2, 90.39, 90.44, 90.27, 90.31, 90.6; 74/559, 569, 567
See application file for complete search history.

(56) References Cited

U.S. PATENT DOCUMENTS 5,121,716 A * 6/1992 Takahashi et al. ..... 123/531
5,937,807 A * 8/1999 Peters et al. ..... 123/90.15
6,668,779 B2 * 12/2003 Hendriksma et al. .... 123/90.44
7,007,650 B2 * 3/2006 Harmon ..... 123/90.44

FOREIGN PATENT DOCUMENTS

| | | |
|---|---|---|
| DE | 44 24 802 | 7/1994 |
| DE | 199 05 364 C1 | 2/1999 |
| DE | 101 56 309 A1 | 7/2002 |
| FR | 976076 | 3/1951 |
| JP | 03-202 603 | 9/1991 |

* cited by examiner

*Primary Examiner*—Ching Chang
(74) *Attorney, Agent, or Firm*—Collard & Roe, P.C.

(57) ABSTRACT

A valve drive for charge-cycling valves of internal combustion engines, which are held in the closed position by means of spring force, and can optionally be activated by a main cam or additionally by a secondary cam of a camshaft, in which connection the main cam with its elevation curve and angle setting is adapted to the crankshaft of a charge-cycling process to be controlled, and the secondary cam operates separately from the main cam. The drive variably controls an additional opening procedure of a charge-cycling valve, separate from the charge-cycling stroke to be controlled directly, in order to sensitively regulate the exhaust gas feed-back in this manner. The drive has two engagement surfaces for introducing movements on a pivot lever mounted on the cylinder head, which activates at least one charge-cycling valve. The first engagement surface on the pivot lever engages the main cam and the second engagement surface on the pivot lever contacts a transfer device for variable adjustment of the valve lift, driven by the second cam.

4 Claims, 4 Drawing Sheets

VALVE DRIVE FOR CHARGE-CYCLING VALVES OF INTERNAL COMBUSTION ENGINES

BACKGROUND OF THE INVENTION

1. Field of the Invention

The invention relates to valve drives for charge-cycling valves of internal combustion engines.

2. The Prior Art

A valve drive of this type, for outlet valves of four-stroke internal combustion engines is described in French Patent No. FR 976.076, in which an outlet valve held in the closed position by a spring force is optionally activated by a first or a second cam, with different lifts of a camshaft. The two cams form an axially displaceable unit that is mounted on the camshaft so as to rotate with it, but to be displaceable. This unit can be displaced into two different positions by a switching fork.

The first cam is adapted to a charge-cycling process to be controlled, with its elevation curve and angle position relative to the crankshaft, and the second cam is active in a different stroke region than the first cam.

In the first position, the first cam is in engagement with the tappet of the valve; in the second position, both the first and the second cam are in engagement with the tappet. The first cam constantly controls the usual opening of the outlet valve after expansion and during expulsion of the combustion gases. The second cam, which can be alternatively placed into a position that is ineffective or effective for the outlet valve, opens the outlet valve, in its effective position, in addition to its usual opening during the intake and/or compression stroke. In this way, the exhaust gas also goes into the cylinder, in addition to the charge that was drawn in, in the case of intake throttling with a low fill volume of the cylinder, so that a greater compression is achieved.

A valve drive for outlet valves of four-stroke internal combustion engines is described in Japanese Patent No. JP 03-202 603, with an outlet cam that has a second elevation and that can be lowered. In its active, outermost position, this elevation opens the outlet valve in addition to its usual opening during the intake and/or compression stroke. In the lowered position, the second elevation is below or at the position of the cam basic circle, and is therefore ineffective.

It is disadvantageous in these embodiments that due to the alternatively effective or ineffective switching of the second cam, the exhaust gas to be introduced in addition to the charge that is drawn in during the intake and/or compression stroke cannot be precisely metered.

A variable valve drive is described in German Patent No. DE 101 56 309 A1, in which a cam with only one elevation is in engagement with a cup tappet, and an additional hydraulic activation device is disposed in the cup tappet. With this activation device, which is supplied and controlled by an additional pressure supply unit, additional opening outside the region of engagement of the cam elevation is possible and an enlargement of the valve opening beyond the opening process of the valve by the lift of the cam can be achieved.

This variable valve drive for outlet valves is used for implementing an exhaust gas feed-back by an additional, multiple opening of the outlet valves outside of the stroke for expulsion of exhaust gas during the intake and/or compression stroke.

German Patent No. DE 44 24 802 C1 describes a process in which an inlet valve is opened during the stroke for expulsion of exhaust gas, in order to bring about an exhaust gas feed-back from the cylinder into the intake system. The inlet valve is activated by a cam having different elevations. For variable activation of the valve for the additional opening process, independent of the lift of the related cam, the hydraulic cushion of the hydraulic valve place adjustment is utilized.

It is a disadvantage of the two valve drives described above that in order to control the additional opening of the charge-cycling valves, a separate pressure system with a control device synchronized with the crankshaft is required.

A method for operating internal combustion engines with variable gas change control times is described in German Patent No. DE 199 05 364 C1. For a direct feed-back of exhaust gas during the intake and compression stroke, the opening time of the outlet valve extends from the end of the expansion stroke over the expulsion stroke to half of the intake stroke, and greater overlap of the valve opening of the outlet and inlet valve occurs.

To the extent that charge-cycling valves are discussed below, these can be both inlet valves and outlet valves.

SUMMARY OF THE INVENTION

It is an object of the invention to variably control an additional opening process of a charge-cycling valve, using a mechanical valve drive, which is separate from the charge-cycling stroke to be controlled directly, in order to regulate the exhaust gas feed-back in sensitive manner.

This object is accomplished by a valve drive for charge-cycling valves of internal combustion engines, which are held in the closed position by spring force and can optionally be activated by a main cam or additionally by a secondary cam of a camshaft. The connection of the main cam with its elevation curve and angle setting is adapted to the crankshaft of a charge-cycling process to be controlled. The secondary cam operates independently of the main cam. There are two engagement surfaces for introducing movements. The engagement surfaces are disposed, in different positions, on a pivot lever mounted on the cylinder head, which activates at least one charge-cycling valve. The first engagement surface on the pivot lever engages the main cam. The second engagement surface on the pivot lever contacts a transfer device for variable adjustment of the valve lift, driven by the second cam.

The use of a pivot lever to activate one or two charge-cycling valves, in an embodiment according to the invention, having two engagement surfaces for the introduction of lifting movements, allows direct engagement with a first main cam that allows for an opening and closing of one or two valve(s), respectively, for a charge cycle, e.g. intake of fresh gas or expulsion of exhaust gas, and an engagement with a transfer device driven by a second cam, for a variable adjustment of the valve lift for feed-back of exhaust gas into the cylinder chamber or also into the intake pipe.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
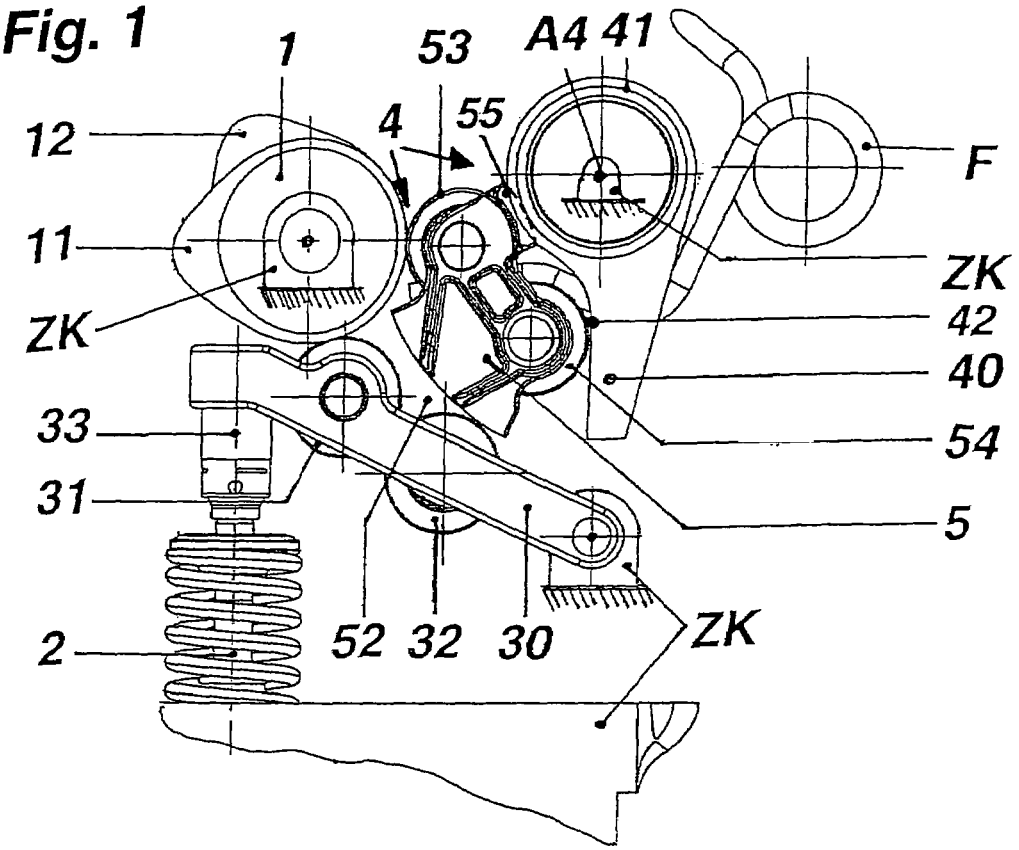
FIG. 1 shows a side view of the elements of a valve drive according to one embodiment of the invention, with a view in the direction of the progression of the camshaft axis.

FIG. 1 shows a side view of the elements of a valve drive according to one embodiment of the invention, with a view in the direction of the progression of the camshaft axis. A camshaft 1 driven by the crankshaft, if necessary by way of an angle adjustment, is mounted in the cylinder head ZK, so as to rotate, with a fixed axis position, and has a fixed position relative to charge-cycling valves 2 and a lift transfer arrangement 3 assigned to them. Lift transfer arrangement 3, guided in a fixed position, is assigned to charge-cycling valves 2 that are disposed in cylinder head ZK and close by means of spring force. It is formed by a pivot lever 30 mounted on cylinder head ZK and provided with a play equalization element 33. A main cam 11 of camshaft 1 is in engagement with pivot lever 30 by way of a roll 31 mounted on pivot lever 30, which roll forms the first engagement surface on pivot lever 30.

Camshaft 1, in addition to the main cam 11 whose elevation curve and angle position relative to the crankshaft is adapted to a charge-cycling process to be controlled, furthermore has a second cam 12 that is active in a different stroke region from main cam 11.

The second engagement surface on the pivot lever 30 forms a roll 32 that is mounted on the lever. It stands in engagement with a transfer device 4 driven by second cam 12, for movements brought about by second cam 12, for variably adjusting the valve lift. Transfer device 4 has an element 40 whose position can be changed and is disposed in a fixed location in the cylinder head ZK so as to pivot about the pivot axis A4, which is in a fixed position, to adjust the valve lift. It forms an adjustable counter-bearing for an intermediate member 5 that is supported on it and is guided during its displacement in this manner. The intermediate member 5 stands in engagement with element 40, which can change its position, with a non-positive lock, by way of roll 54 mounted, on its control cam 42 as well as with slide supports 55 on the support cams 41 disposed on both sides of the control cam 42. Support cams 41 are radially offset towards the rear, with a non-positive lock. The outer contour of support cams 41 is formed by an arc about pivot axis A4 (see FIG. 2 in this regard). An axial guidance of intermediate member 5 is achieved by support cams 41 on both sides that are radially offset towards the rear, as compared with control cam 42. This arrangement results in a prismatic support of intermediate member 5 on element 40 that is changeable in its position, in the case of every position during the lift movement.

Furthermore, intermediate member 5 is in engagement with second cam 12 of camshaft 1, with the roll 53 mounted on it, and furthermore with a roll 32 of lift transfer arrangement 3 assigned to charge-cycling valves 2, by way of its outer contour 52.

Intermediate member 5 is held in engagement with second cam 12 and changeable element 40, with a non-positive lock, under the effect of the force of a spring F. For this purpose, spring F is supported and guided on intermediate member 5 in a sliding manner in the region of roll 53, and fixed in place on the cylinder head ZK (not shown).

Figure 3:
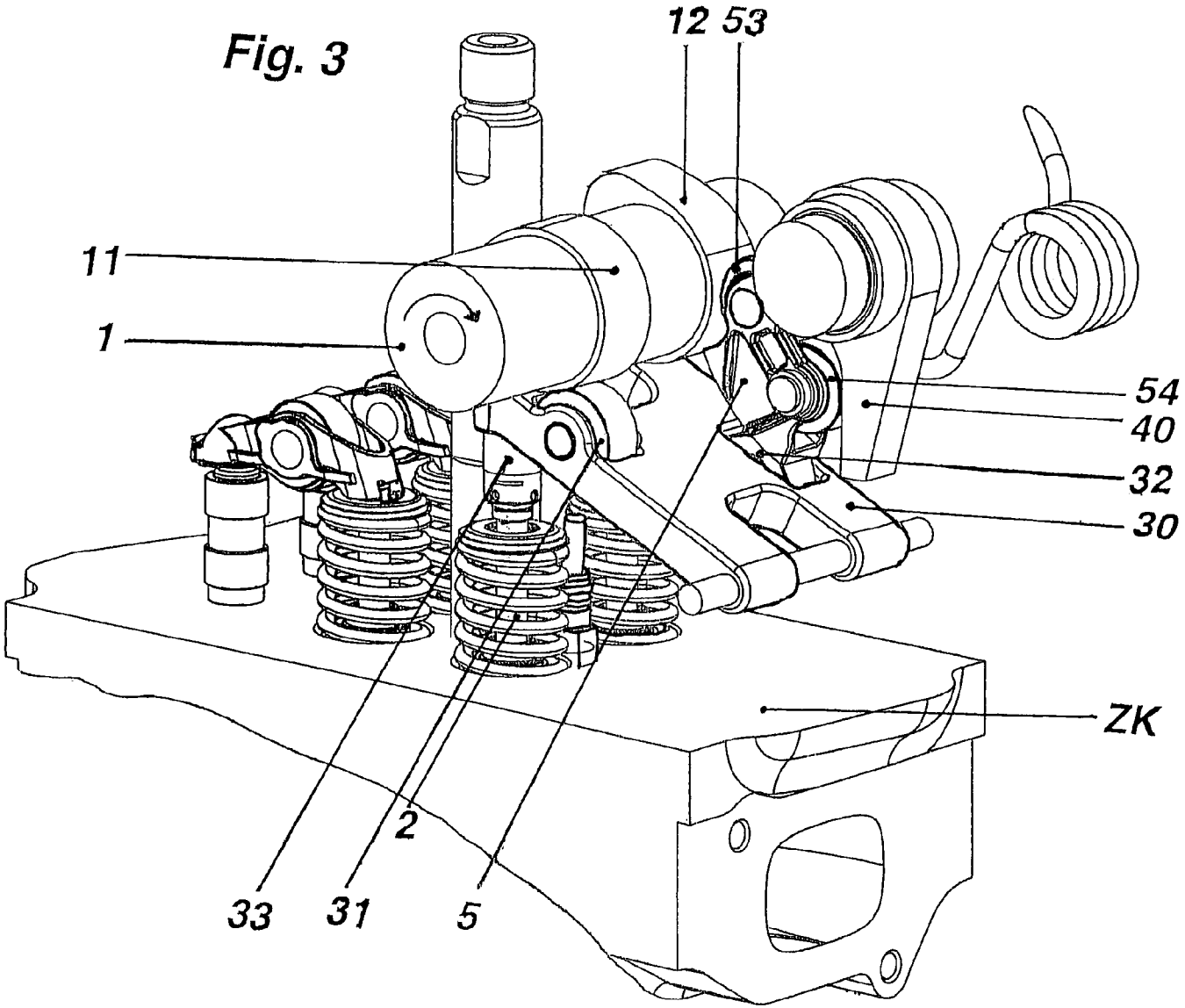
FIG. 3 shows a perspective view of a valve drive according to an embodiment of the invention.

FIG. 3 shows a perspective view of the valve drive according to the invention, in connection with all the charge-cycling valves assigned to the cylinder, and their drive mechanisms, as well as an injection nozzle disposed in the center of the combustion chamber.

Figure 4:
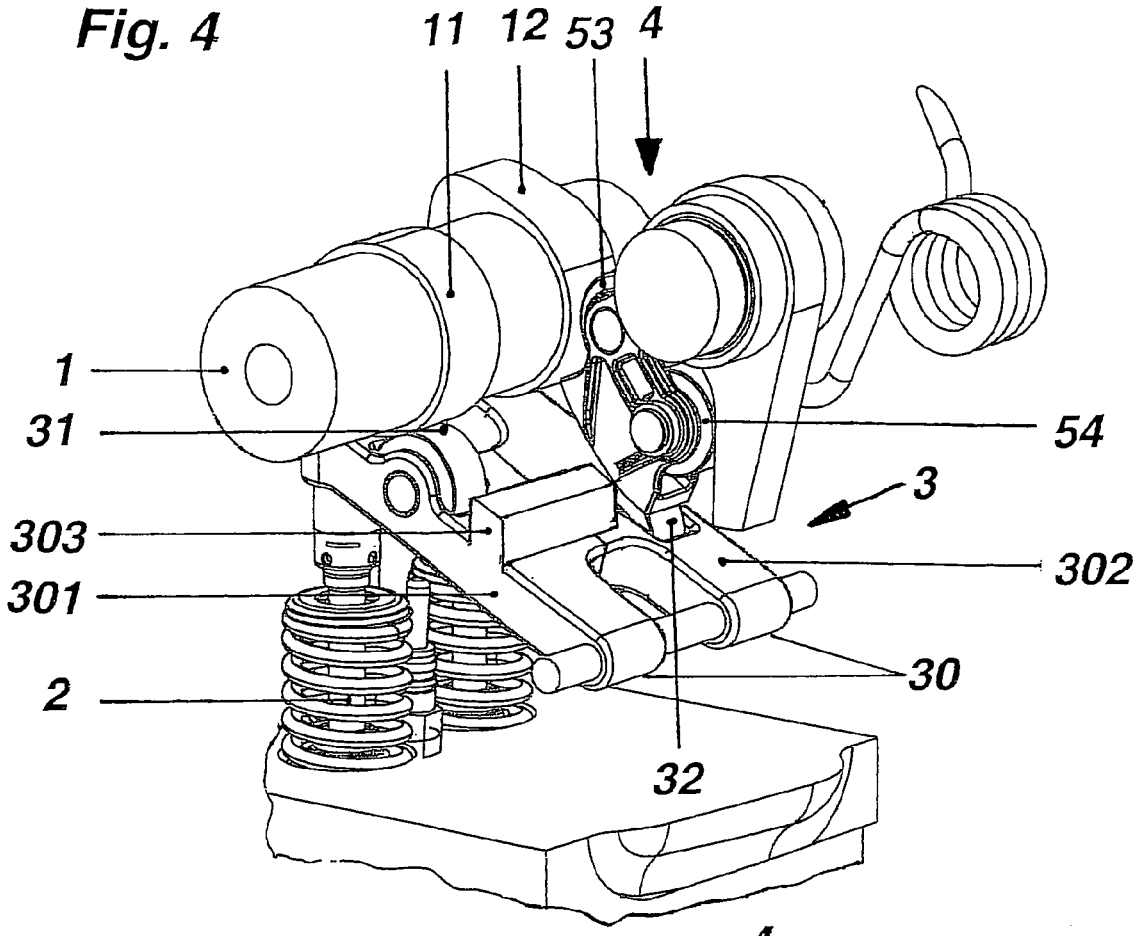
FIG. 4 shows a perspective view of a second embodiment of a valve drive according to the invention, having a two-part pivot lever.
Figure 5:
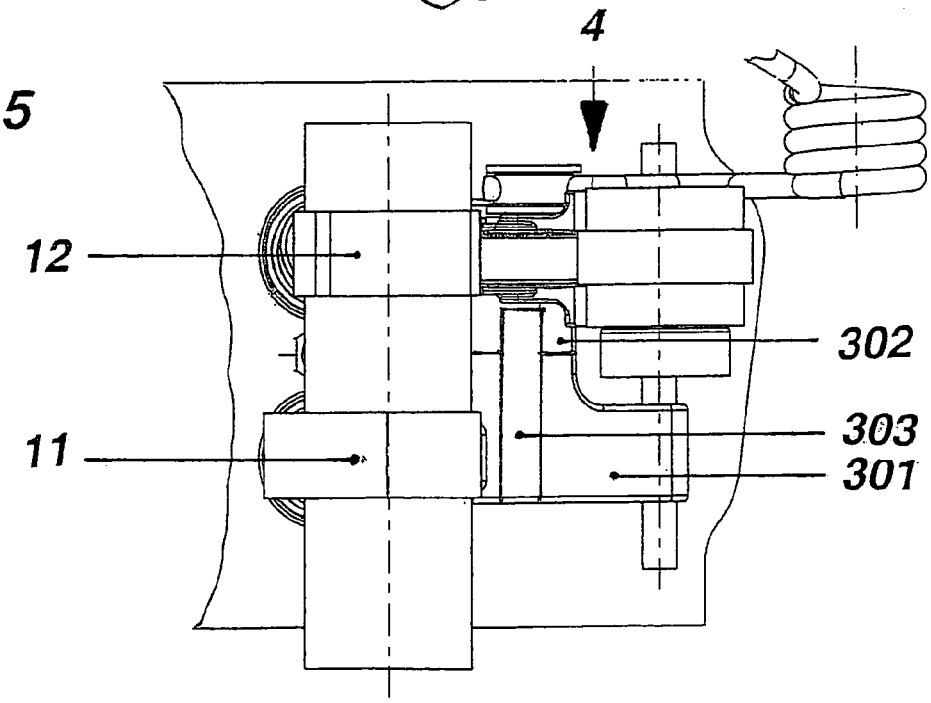
FIG. 5 shows a view from above, onto an embodiment of the valve drive according to FIG. 4.

FIG. 4 shows a second embodiment of a valve drive according to the invention, with a two-part pivot lever, in a perspective view. FIG. 5 shows this valve drive from above. In contrast to the first embodiment, the pivot lever 30 is configured in two parts and consists of a main pivot arm 301 and a secondary pivot arm 302, in each instance, whereby these two pivot arms 301, 302 are articulated independent of one another, but with the same axis, and are in engagement with one of the charge-cycling valves 2, in each instance.

Main pivot arm 301 has roll 31 as an engagement surface for the first main cam 11, on the one hand, and a driver 303 that acts exclusively in the direction of the open valve and stands in engagement with the secondary pivot arm 302, on the other hand.

Secondary pivot arm 302 additionally stands in engagement with transfer device 4 driven by second cam 12, by way of roll 32 that is mounted on it. Transfer device 4 is the same as the one in the valve drive described according to FIGS. 1 to 3.

This second embodiment of a valve drive has the following fundamental functional behavior: The movements brought about by main cam 11 are constantly transferred to both charge-cycling valves 2. In contrast, the movements brought about by second cam 12 only become effective at charge-cycling valve 2 assigned to the secondary pivot arm 302, as a function of the setting of the transfer device 4.

Fundamentally, the structure of transfer device 4 and its function for varying the valve lift are already known from DE 202 20 138 U1, and need not be described in detail here.

Figure 2:
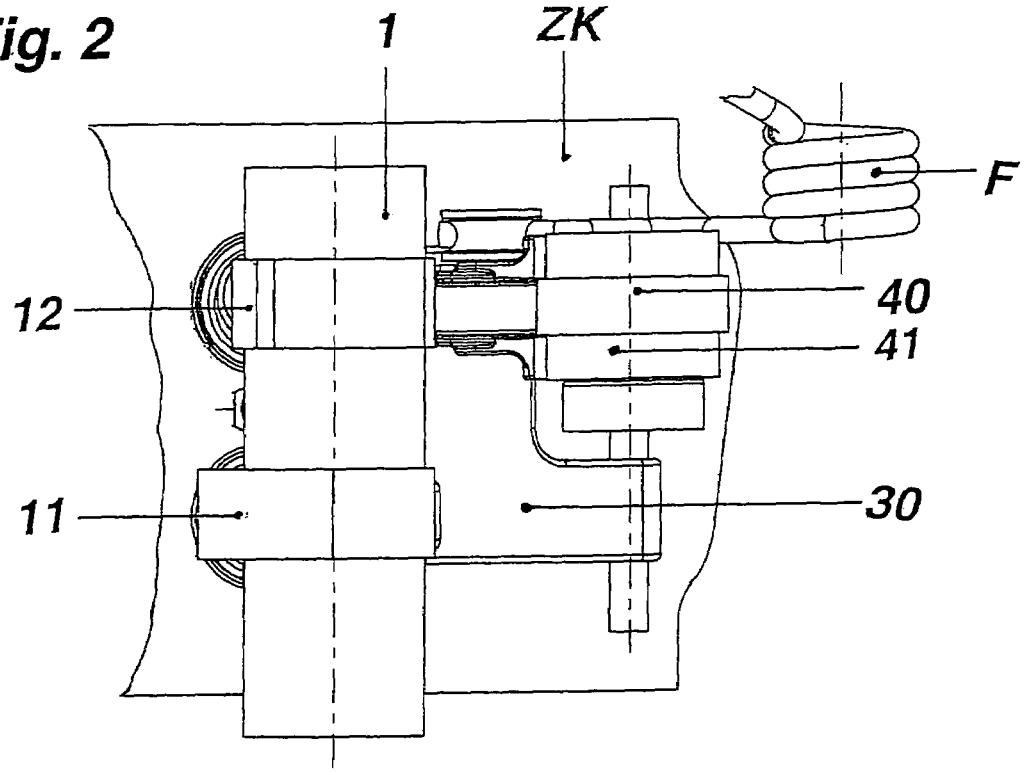
FIG. 2 shows a view from above onto the valve drive according to an embodiment of the invention.

The embodiment shown in FIGS. 1-3 functions as follows: The charge-cycling valves 2 are closed. Rolls 31 and 53, in each instance, are in engagement with the basic circle of the main cam 11 and second cam 12, respectively. In case of a further rotation from this position, in a clockwise direction, roll 53 is first constantly forced in the direction of the opening of the valve, from the elevation of second cam 12 until the outermost cam contour is reached, and subsequently valve 2 is closed by spring force, not shown. During the movement progression, intermediate member 5 glides on support cam 41 and control cam 42, with line contact, and in the direction of the longitudinal expanse, by way of the roll 32 of lift transfer system 3. By means of the structure and the set angle position of element 40 with the control cam 42, an adjustable, variable opening of the two charge-cycling valves 2 is possible. In case of further rotation, main cam 11 moves pivot lever 30, by way of roll 31, which lever always opens the two charge-cycling valves 2 at a constant lift, in usual manner.

With the embodiment shown in FIGS. 4 and 5, the movements brought about by the main cam 11 are always transferred to both charge-cycling valves 2. In contrast, movements brought about by second cam 12 only become effective at the charge-cycling valve 2 assigned to secondary pivot arm 302, as a function of the setting of transfer device 4.

According to FIGS. 4 and 5, the charge-cycling valves 2 of the valve drive are closed. Rolls 31 and 53 are in engagement with the basic circle of main cam 11 or second cam 12, respectively, in each instance. In case of further rotation of the camshaft 1 in the clockwise direction, from the position shown in the aforementioned figures, roll 53 is first constantly forced in the direction of the opening of the valve, from the elevation of second cam 12 until the outermost cam contour is reached, whereby charge-cycling valve 2 assigned to secondary pivot arm 302 is opened as a function of transfer device 4, and subsequently closed by means of spring force, not shown.

With the structure and the set angle position of the element 40 with control cam 42, in each instance, adjustable, variable opening of charge-cycling valve 2 activated by secondary pivot lever 302, in each instance, is possible. During this process, main pivot arm 301 continues to support itself on the basic circle of main cam 11. Charge-cycling valve 2 assigned to the main pivot arm 301 remains closed.

In case of further rotation, main cam 11 moves main pivot arm 301 with driver 303, which is in engagement with secondary pivot arm 302 in the direction of the open valve, by way of the roll 31. In usual manner, the two charge-cycling valves 2 are always opened by the main cam 11 at a constant lift.

Figure 6:
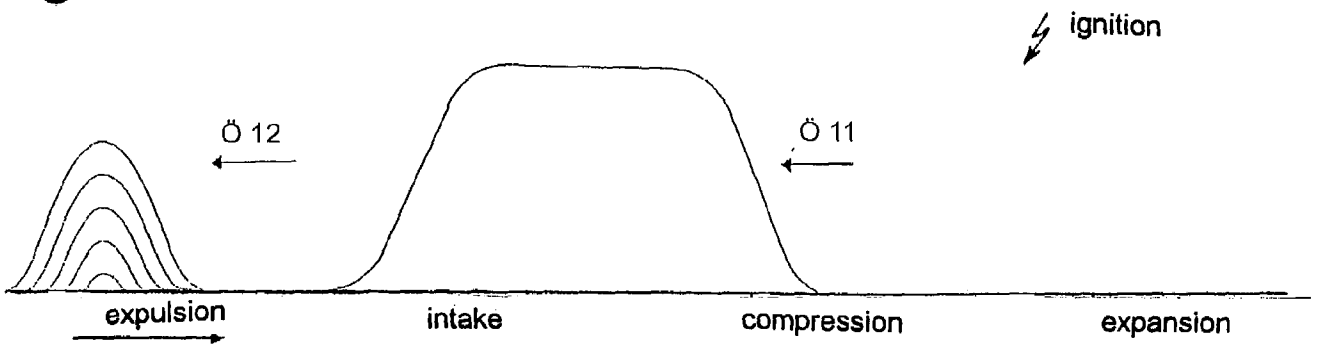
FIG. 6 shows valve elevation curves with valve drives according to the invention, for inlet valves
Figure 7:
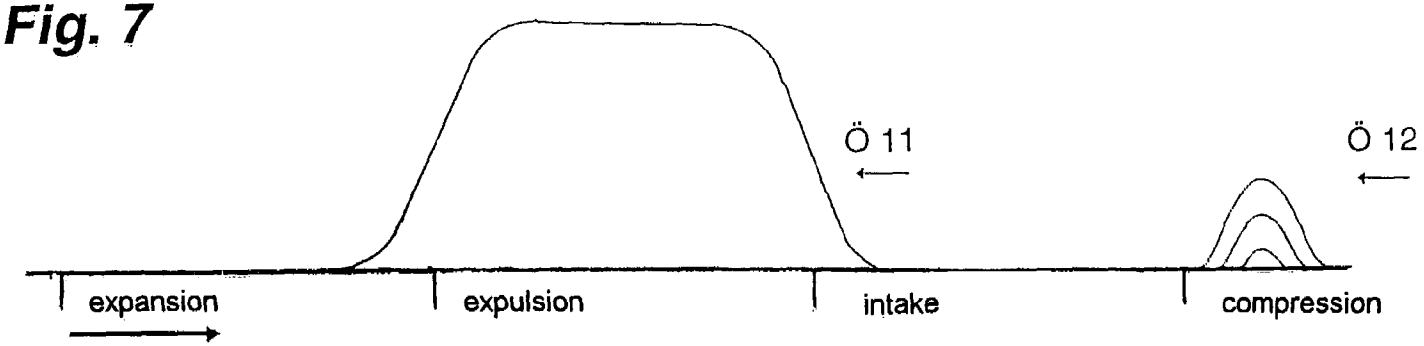
FIG. 7 shows valve elevation curves with valve drives according to the invention, for outlet valves.

Possible valve elevation curves that can be implemented with the valve drives according to the invention are shown in FIGS. 6 and 7 and will be explained below.

FIG. 6 shows valve elevation curves of inlet valves with the location in the stroke regions of four-stroke engines that can be implemented with valve drives according to the invention. In this case, the charge-cycling valves 2 are inlet valves.

With the embodiment according to FIG. 3, both inlet valves are always activated synchronously. Main cam 11 always opens the two inlet valves at a constant lift during intake, see Ö11.

The adjustable opening of the two inlet valves takes place by way of the second cam 12 and transfer device 4, see curve group Ö12, even during expulsion of the exhaust gases. In this way, exhaust gas feed-back from the cylinder into the intake tract is achieved. If such exhaust gas feed-back is not desired, opening is prevented by second cam 12, by means of transfer device 4. Both inlet valves remain in the closed state.

In the case of an embodiment of the valve drive according to FIG. 4 or 5, the two inlet valves are always opened at a constant lift during intake, by main cam 11, see Ö11. Adjustable opening only of the inlet valve activated by secondary pivot arm 302 takes place exclusively by way of second cam 12 and transfer device 4, in accordance with the curve group Ö12 shown in FIG. 6. The inlet valve activated by main pivot arm 301 remains closed.

With this embodiment, in which only one of the inlet valves is effective for exhaust gas feed-back, more precise metering of the amount of exhaust gas fed back can be achieved.

FIG. 7 shows valve elevation curves of outlet valves with their location in the stroke regions of four-stroke engines that can be implemented with valve drives according to the invention. In this case, the charge-cycling valves 2 are outlet valves.

When using an embodiment of the valve drive according to FIG. 3, the two outlet valves are always activated synchronously. Main cam 11 opens both outlet valves at the end of the expansion stroke, and during expulsion, always at a constant lift, see Ö11.

The adjustable opening of the two outlet valves, see curve group Ö12, can take place by way of second cam 12 and the transfer device 4, even during the beginning of compression, but after closing of the inlet valves. In this way, exhaust gas feed-back from the exhaust gas tract into the cylinder is achieved.

If such exhaust gas feed-back is not desired, opening of the outlet valves is prevented by second cam 12, by means of transfer device 4. Both outlet valves remain in the closed state.

When using an embodiment of the valve drive according to FIG. 4 or 5, both outlet valves are opened by main cam 11 at the end of the expansion stroke and during expulsion, always at a constant lift, see Ö11.

Adjustable opening only of the outlet valve activated by secondary pivot arm 302 takes place exclusively by way of second cam 12 and transfer device 4, corresponding to curve group Ö12 shown in FIG. 7. The outlet valve activated by the main pivot arm 301 remains closed.

With this embodiment, in which only one of the outlet valves is active for exhaust gas feed-back, it is possible to achieve more precise metering of the amount of exhaust gas fed back, if necessary even an influence on the charge movements in the cylinder chamber.

If no exhaust gas feed-back is desired, opening of the outlet valve is prevented by second cam 12, by means of the transfer device 4.

To achieve several lifts, second cam 12 can have several elevations that are effective separate from main cam 11. If the elevations on second cam 12 are different, it is possible to adjust the size of the additional lifts depending on the position of changeable element 40, in each instance and, for example, to suppress lifts that result from slight elevations on second cam 12.

In the latter case, not all the elevations on second cam 12 become effective for opening charge-cycling valves. However, such an embodiment is not shown in any of the Figures.

Accordingly, while only a few embodiments of the present invention have been shown and described, it is obvious that many changes and modifications may be made thereunto without departing from the spirit and scope of the invention.

REFERENCE SYMBOLS

1 camshaft
11 main cam
12 second cam
2 charge-cycling valve
3 lift transfer arrangement
30 pivot lever
31 roll
32 roll
33 play equalization element
301 main pivot arm 301
302 secondary pivot arm
303 driver on 301
4 transfer device for movements brought about by the second cam 12
40 element, changeable in its position, pivotable
41 support cam
42 control cam

5 intermediate member
52 outer contour
53 roll
54 roll
55 slide support
F spring whose force engages at 5 and places against 4 and 12
ZK cylinder head
Ö11 opening of valves 2 by means of the main cam 11
Ö12 adjustable opening of valves 2 by the second cam 12

What is claimed is:

1. A valve drive for charge-cycling valves of internal combustion engines, which are held in a closed position by means of spring force, comprising:

a main cam and a second cam of a camshaft for activating the valves, wherein connection of the main cam with its elevation curve and angle setting is adapted to the crankshaft of a charge-cycling process to be controlled, and wherein the second cam operates separately from the main cam; and first and second engagement surfaces for introducing movements, said surfaces being disposed, in different positions, on a pivot lever mounted on a cylinder head of the engine, said lever activating at least one of said charge-cycling valves;

wherein the first engagement surface on the pivot lever engages the main cam and wherein the second engagement surface contacts a transfer device for variable adjustment of a valve lift for feedback of exhaust gas into the cylinder chamber or also into the intake pipe, wherein said valve lift is driven by the second cam and wherein the transfer device comprises an element having a variable position and which is disposed in a fixed location in the cylinder head, and wherein the valve lift is variable and adjustable based on a structure and set angle position of said element.

2. The valve drive according to claim 1, wherein the pivot lever engages two charge-cycling valves.

3. The valve drive according to claim 1, wherein the pivot lever is configured in two parts and consists of a main pivot arm and a secondary pivot arm, said pivot arms being adapted to pivot independently of one another, and being articulated in a same axis, wherein each of said pivot arms are in engagement with one of the charge-cycling valves, and wherein the engagement surface for the main cam is on the main pivot arm, and a driver that acts exclusively in a direction of an open valve engages the secondary pivot arm, and wherein the secondary pivot arm contacts a transfer device for variable adjustment of the valve lift, which is driven by the second cam.

4. The valve drive according to claim 1, wherein the second cam has several different elevations.

* * * * *